US006332796B1

(12) United States Patent
Chen

(10) Patent No.: US 6,332,796 B1
(45) Date of Patent: Dec. 25, 2001

(54) STRUCTURE OF A FLUORESCENT TUBE SEAT

(76) Inventor: Chuan-Ying Chen, PO Box 82-144, Taipei (TW)

( * ) Notice: Subject to any disclaimer, the term of this patent is extended or adjusted under 35 U.S.C. 154(b) by 0 days.

(21) Appl. No.: 09/684,661

(22) Filed: Oct. 10, 2000

(51) Int. Cl.[7] ..... H01R 33/02

(52) U.S. Cl. ..... 439/226; 439/356; 439/364; 439/699.2

(58) Field of Search ..... 439/226, 227, 439/356, 364, 357, 360, 699.2

(56) References Cited

U.S. PATENT DOCUMENTS 4,246,629 * 1/1981 Marrero ..... 362/147
5,289,079 * 2/1994 Wittmann ..... 313/318
5,349,513 * 9/1994 Taylor, III ..... 362/404
5,545,950 * 8/1996 Cho ..... 315/56
5,630,729 * 5/1997 Francis ..... 439/548
5,634,820 * 6/1997 Vakil ..... 439/646
5,783,788 * 7/1998 Jones et al. ..... 200/51.17
6,022,118 * 2/2000 Wu ..... 362/35
6,135,622 * 10/2000 Downing ..... 362/410
6,162,079 * 12/2000 Slazakowski ..... 439/244

* cited by examiner

*Primary Examiner*—Renee Luebke
*Assistant Examiner*—Truc T Nguyen
(74) *Attorney, Agent, or Firm*—A & J

(57) ABSTRACT

The present invention relates to an improved structure of a fluorescent light-tube seat comprising a base seat, a panel, an axle, an engaging peg, a spring, a hole covering an "Π"-shaped member, two conducting copper plates, wherein two fluorescent light-tube seats are used as one module to facilitate the installation of the fluorescent light-tube by vertically repeating pushing dismantling action of the fluorescent light-tube.

2 Claims, 7 Drawing Sheets

STRUCTURE OF A FLUORESCENT TUBE SEAT

BACKGROUND OF THE INVENTION (a) Technical Field of the Invention

The present invention relates to a fluorescent tube seat, and in particular, a fluorescent tube seat, which can retains a fluorescent tube being mounted at any angle, without adjusting the angle of the fluorescent tube in the process of installation.

(b) Description of the Prior Art

A conventional structure of a light tube seat is shown in FIG. 1. For such conventional fluorescent light tube seat, after it has been used for a period of time, it possesses the following shortcomings, which are required to be improved.

When a fluorescent light tube a is to be installed to a conventional tube seat, the tube pins b of the fluorescent tube at one end thereof have to be in alignment with the insertion holes 1 of a spring-support seat 2 by using one hand, and the other hand of the user is used to hold the spring-seat 2 for the other end of the light tube seat. In other words, both of the hands have to be used in installing the fluorescent light tube into the light tube seat. In addition, the light tube pins are not easily made in alignment with the insertion holes of the fluorescent tube seat. Thus, it is rather time consuming and inconvenience to mount the fluorescent light tube into the tube seats.

Another type of conventional light tube seat is the rotatable light tube seat, which is shown in FIG. 2. When a fluorescent light tube is mounted, the light tube pins b of the light tube a are respectively in alignment with guiding slots 3 and then the pins b are rotated until the pins b are in contact with conducting plates at the light tube seat.

SUMMARY OF THE INVENTION

Accordingly, it is an object of the present invention to provide an improved structure of a fluorescent light-tube seat comprising a base seat, a panel, an axle, an engaging peg, a spring, a hole cover, an "Π"-shaped member, two conducting copper plates, wherein two fluorescent light-tube seats are used as one module to facilitate the installation of the fluorescent light-tube tube by vertically pushing action of the fluorescent light-tube tube.

Yet another object of the present invention is to provide an improved structure of a fluorescent light-tube seat, wherein the front end of the seat body is provided with a "Π"-shaped recess, and the bottom end of the lateral wall of the recess is a curved surface, and the center area of the top end of the seat body is a cylindrical slot in communication with the "Π"-shaped recess, the bottom end of the cylindrical slot is provided with a protruded edge, and the walls of the cylindrical slot is provided with two kinds of ribs of different height and thickness such that a lower rib is located in between two higher ribs, forming three spaced apart ribs on the walls.

Another object of the present invention is to provide an improved structure of a fluorescent light-tube seat, wherein a panel has two straight substantially guiding slots with a distance being equal to the distance of the tube pins, and a contacting end formed on the panel is provided with a plurality of insertion pegs and a mounting block is positioned in between two guiding slots, and the lateral sides of the mounting block is provided with an engaging slot and the bottom edge thereof is tilted toward the interior thereof.

A further object of the present invention is to provide an improved structure of a fluorescent light-tube seat, wherein an engaging peg is a hollow peg body mounted onto the top end of an axle, the top end of the peg is a cap edge having a diameter smaller than that of the cylindrical slot, and the circumferential edge of the cap edge is formed into three engaging teeth structures.

Another further object of the present invention is to provide an improved structure of a fluorescent light-tube seat, wherein the axle pivotally mounted at the hollow tube body of the cylindrical slot, having the top end formed into 6 wave-like elements and the external edge surface of the tube is provided with a plurality of rails thereon.

Yet another flier object the present invention is to provide an improved structure of a fluorescent light-tube seat, wherein a hole cover having a surface provided with openings for wires, is used to seal the hole on the cylindrical slot.

A further object of the present invention is to provide an improved structure of a fluorescent light-tube seat, wherein an "Π"-shaped member is mounted at the bottom end of the axle and is located in between the mounting block and the "Π"-shaped recess.

Yet a flier object is to provide an improved structure of a fluorescent light-tube seat, wherein two conducting copper plates are respectively mounted at the sides of the "Π"-shaped member.

Other object and advantages of the present invention will become more apparent from the following description taken in conjunction with the accompanying drawing.

DETAILED DESCRIPTION OF THE PREFERRED EMBODIMENT

Figure 1:
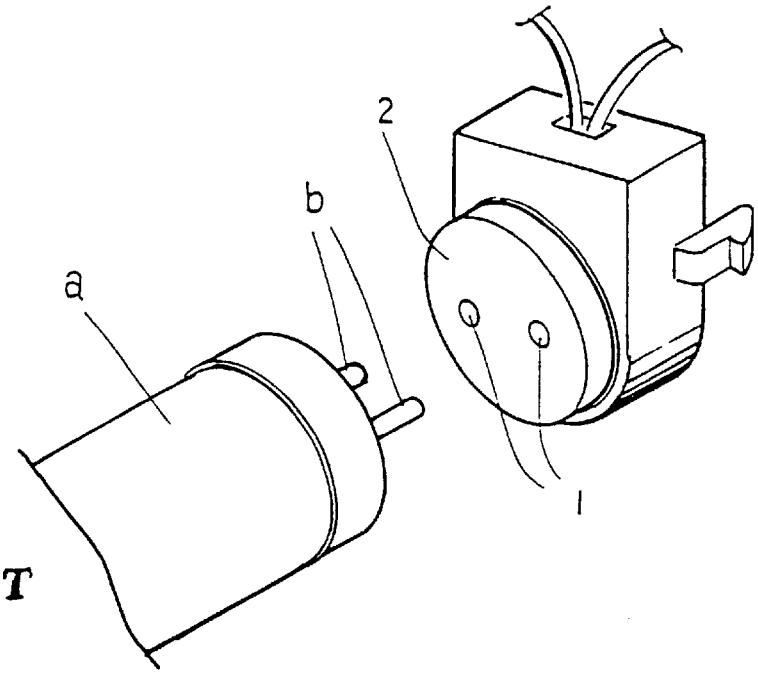
PRIOR ART FIG. 1
FIG. 1 is a perspective view of a conventional fluorescent light-tube tube seat.
Figure 2:
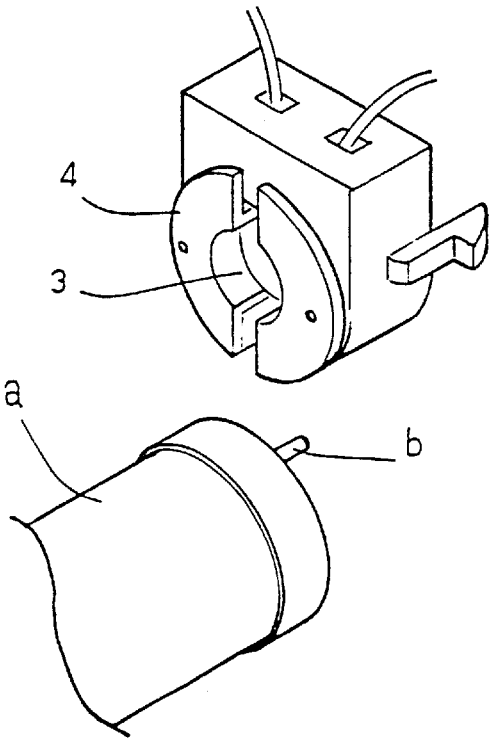
PRIOR ART FIG. 2
FIG. 2 is a perspective view of another conventional light tube.
Figure 3:
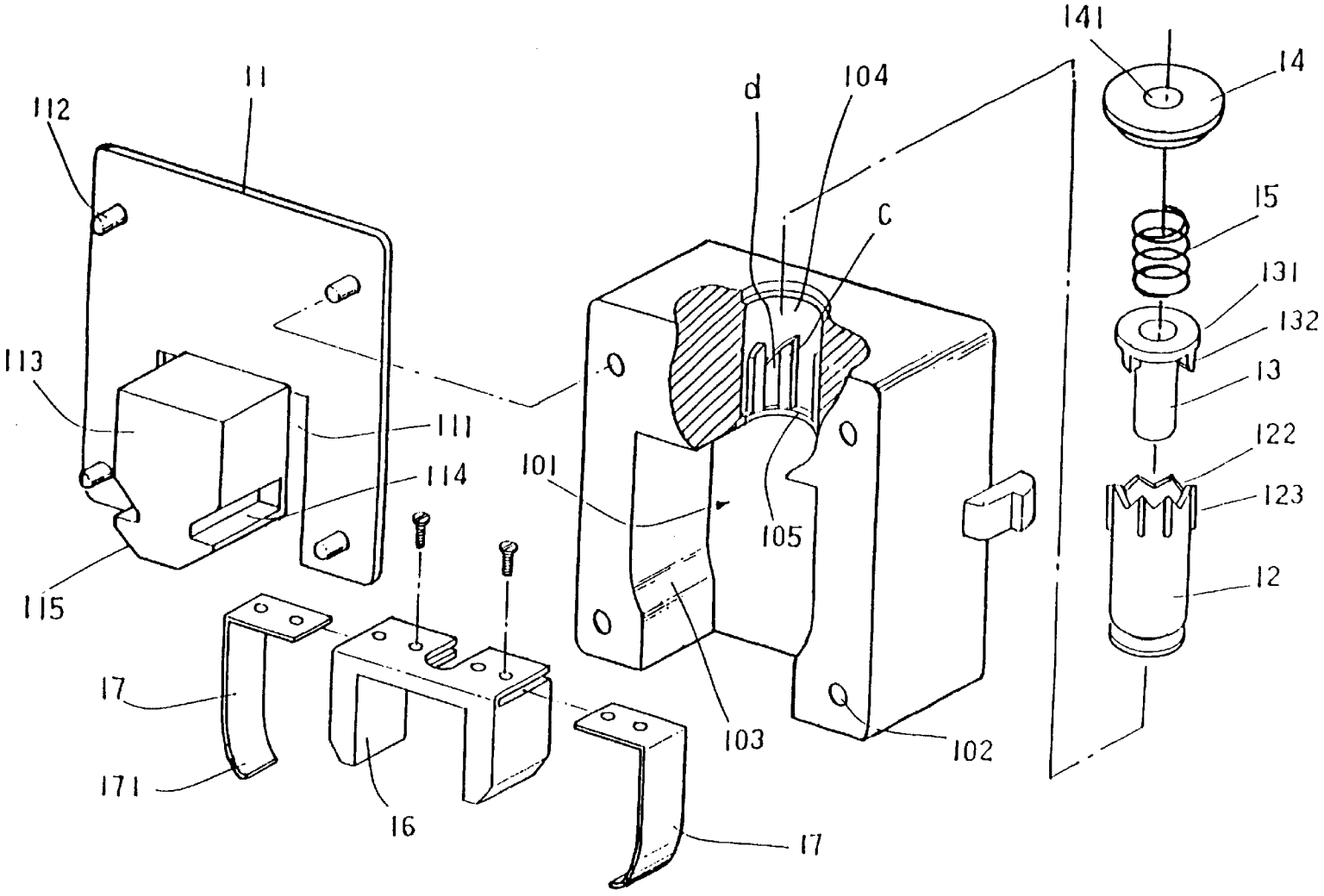
FIG. 3 is a perspective exploded view of a fluorescent tube seat of a preferred embodiment in accordance with the present invention.
Figure 4:
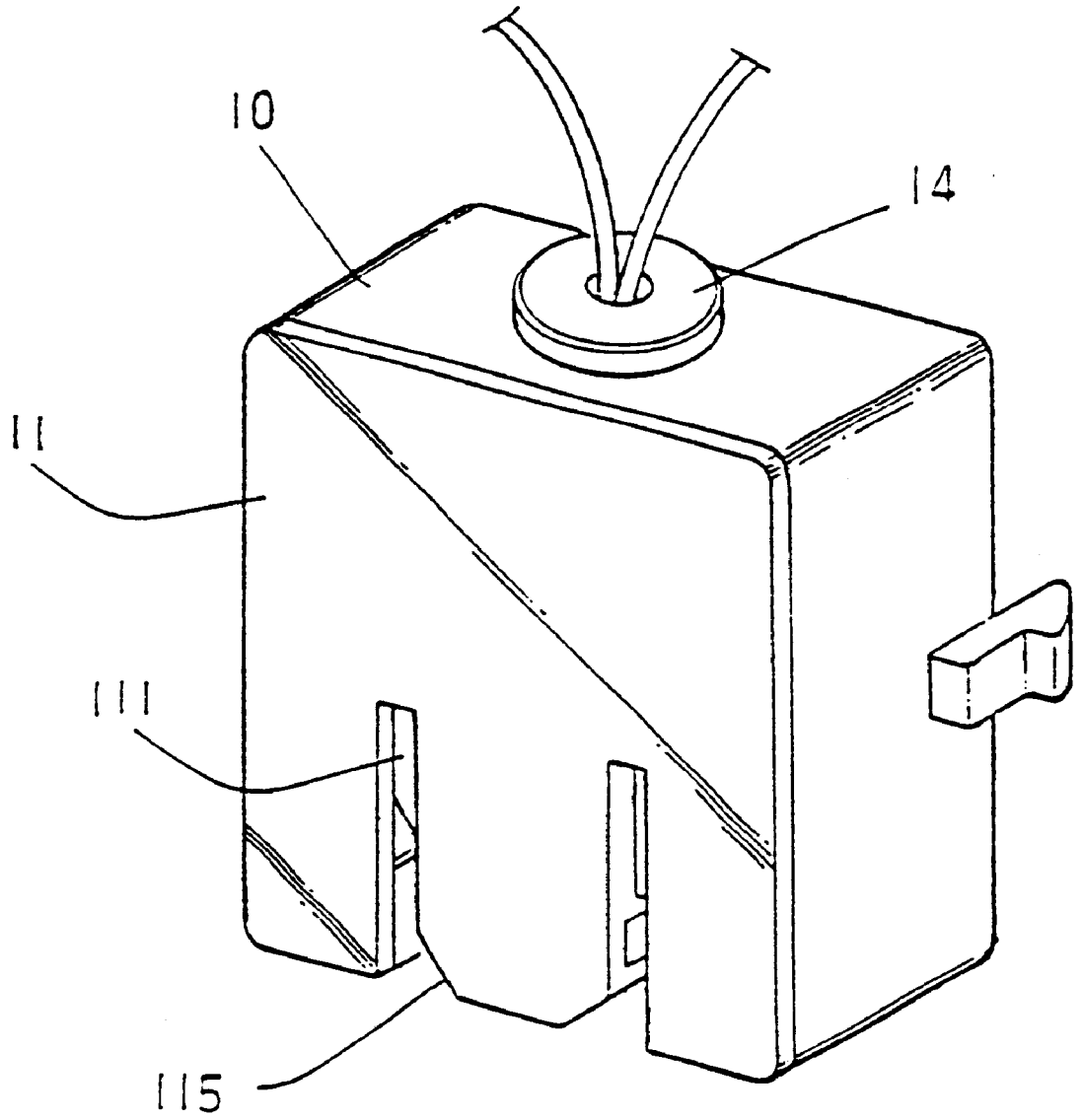
FIG. 4 is a perspective view of a light tube seat of the present invention.
Figure 5:
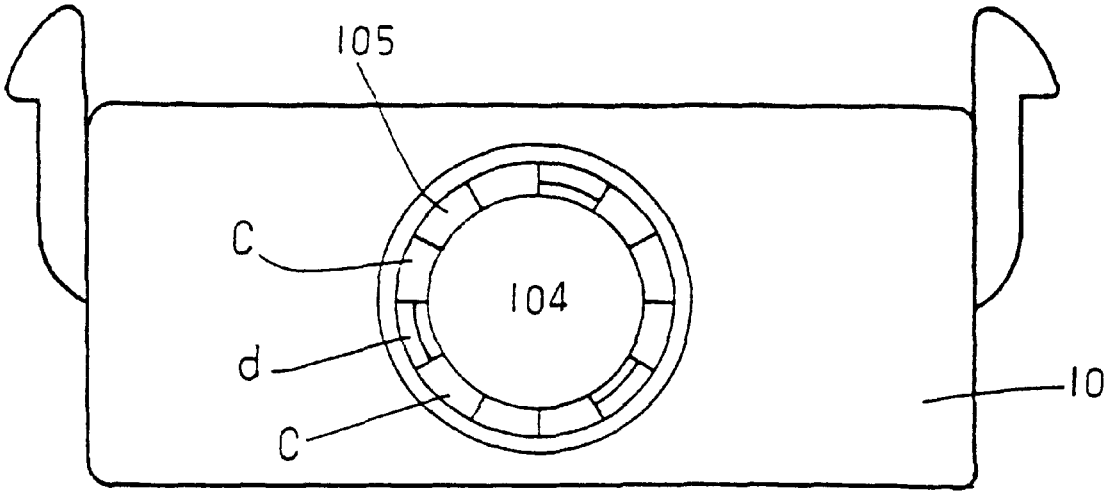
FIG. 5 is a top view of the light tube seat of the present invention.
Figure 6:
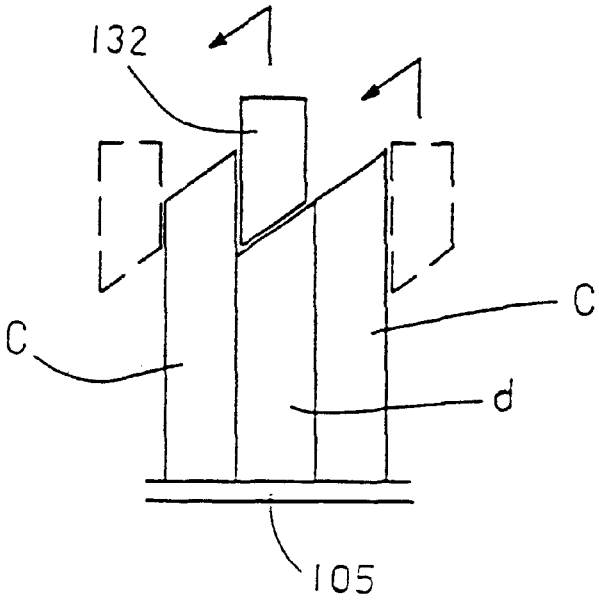
FIG. 6 is a schematic view showing the structure of the engaging teeth of the engaging peg and the protruded rib in accordance with the present invention.

Referring to FIGS. 3 and 4, there is shown an improved structure of a fluorescent light-tube seat comprising a base seat 10, a panel 11, an axle 12, an engaging peg 13, a hole cover 14, a spring 15, a "Π"-shaped member 16, and two conducting copper plates 17, wherein the base seat 10 having a front end being provided with a "Π"-shaped recess, and the bottom end of the lateral wall of the recess being a curved surface, and the center area of the top end of the seat body being a cylindrical slot in communication with the "Π"-shaped recess, the bottom end of the cylindrical slot being provided with a protruded edge, and the walls of the cylindrical slot being provided with two kinds of fibs of different height and thickness such that a lower rib is located in between two higher ribs, forming three ribs which are spaced apart and arranged on the walls;

As shown in the figure, the panel 11 has two parallel straight guiding slots 111 with a distance equals to the distance of the tube pins, and a mounting block 113 is provided in between two guiding slots 111, the lateral sides of the mounting block 113 is provided with an engaging slot 114, and the bottom edge thereof forms a slanting angle 115 toward the interior thereof.

The axle 12 is pivotally mounted at the hollow tube body of the cylindrical slot 104 and the top edge of the slot 104 is formed into 6 wave-like elements and the external edge surface of the tube body is formed into a plurality of corresponding teeth structures and a rail 123 is provided thereon. The engaging peg 13 is a hollow peg body mounted onto the top end of the axle 12, and the top end of the peg 13 has a cap edge having a diameter smaller than that of the cylindrical slot 104, and the circumferential edge of the cap edge is formed into tree engaging teeth structures 132.

The hole cover 14 has a surface provided with openings 141 for wires. In accordance with the present invention, the spring 15 is urged between the top end of the engaging peg 13 and the hole cover 14, and the "Π"-shaped member 16 is mounted at the bottom end of the axle 12, and it reciprocates within the "Π"-shaped recess 101. The two conducting copper plates 17 has a bottom end which form into an arch-shaped structure 171 and is mounted at the sides of the "Π"-shaped member 16.

Figure 7:
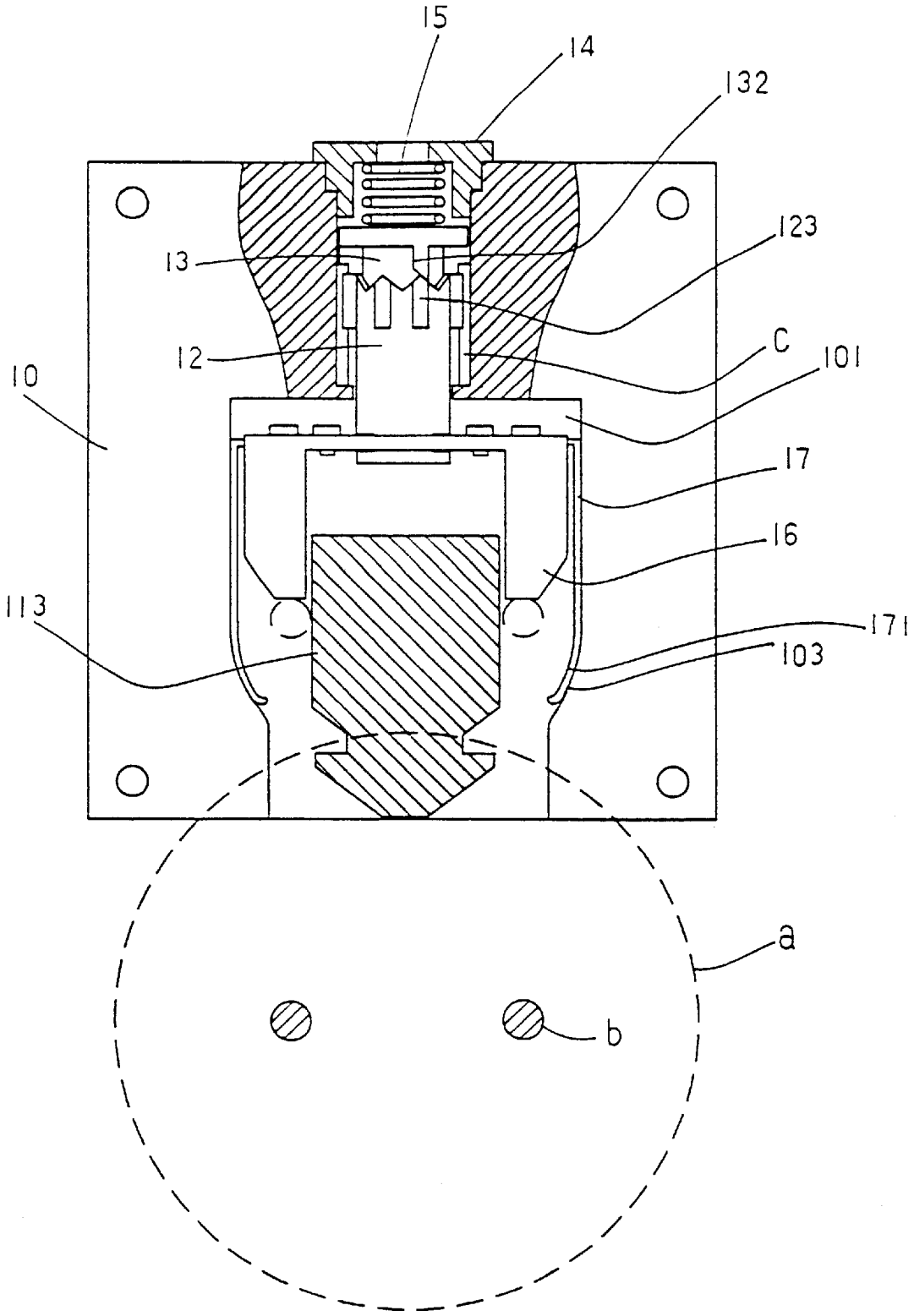
FIG. 7 is a schematic view showing the tube seat before a fluorescent tube is mounted thereto in accordance with the present invention.
Figure 8:
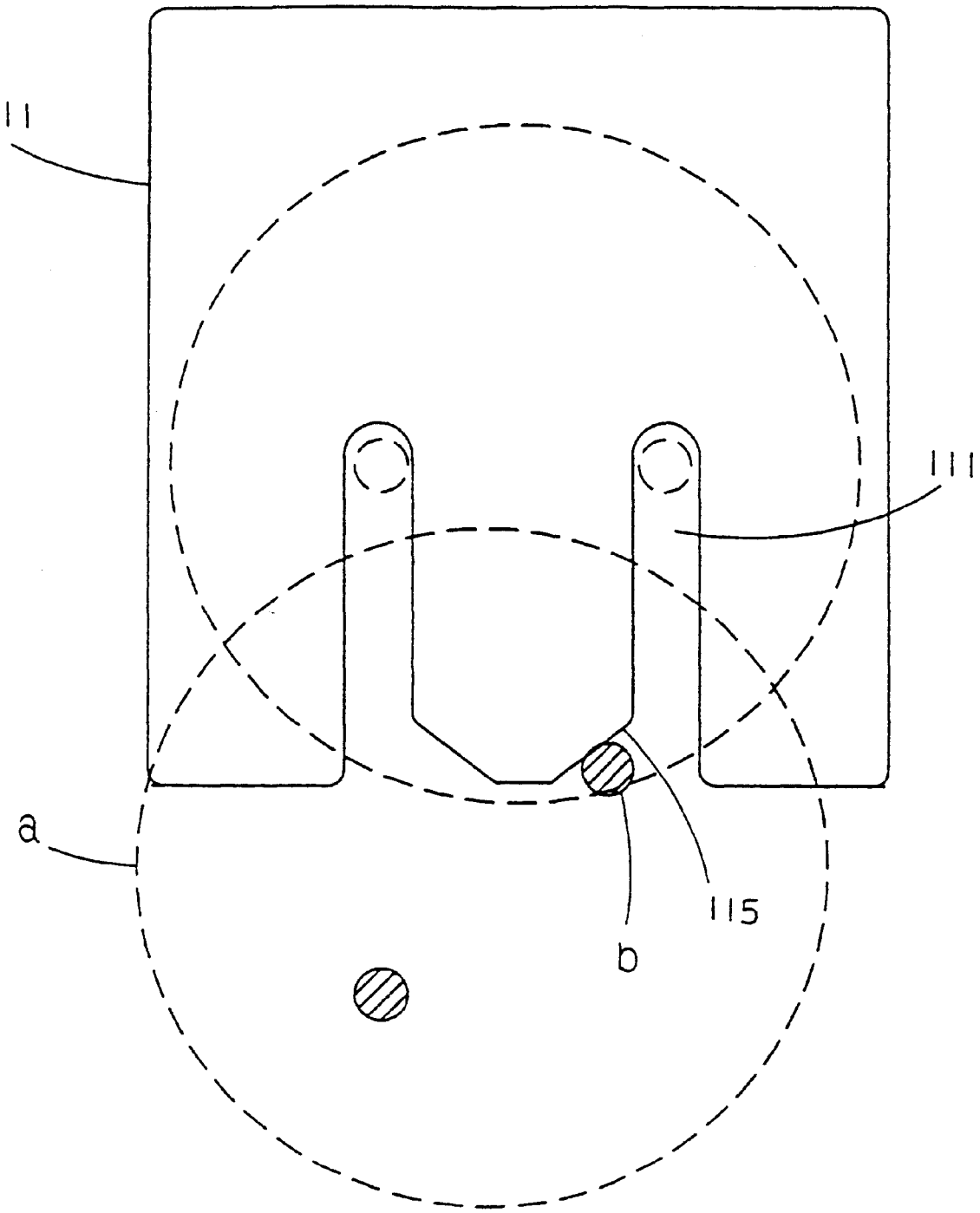
FIG. 8 is a schematic view showing the tube seat after a fluorescent tube is mounted thereto in accordance with the present invention.
Figure 9:
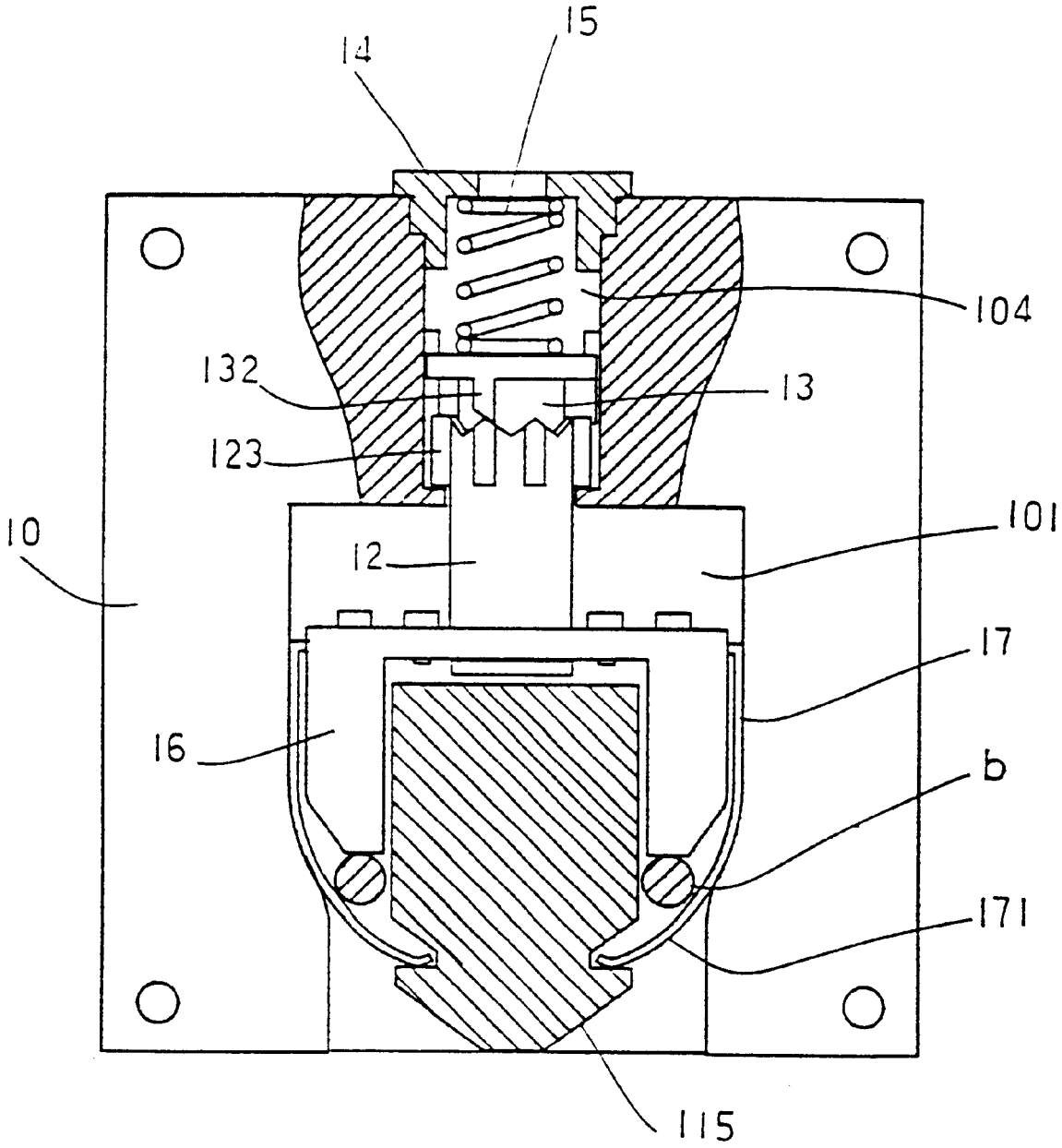
FIG. 9 is a schematic view showing the tube seat after a fluorescent tube is mounted thereto in accordance with the present invention.

In accordance with the present invention, the operation of the structure of the bulb-seat is explained hereinafter. FIG. 7 shows the structure of the present invention where the fluorescent light tube has not been mounted. In accordance with the present invention, the engaging peg 13 compresses the engaging teeth 132 having the spring 15, and the teeth 132 urges the top edge of the protruded rib d and is mounted at the "Π"-shaped member 16 between the mounting block 113 and the "Π"-shaped recess 101. By mean of the arch-shaped corner 171 at the bottom end of the two conducting copper plates 17 and the curved surface face 103 at the two lateral sides of the "Π"-shaped recess 101, sufficient support is provided to the mounting block 113 to allow the light bulb seat to be slightly pushed toward. In application, two tube seats are employed as a module and are located to face the panel 11. To mount the fluorescent tube, as shown in FIGS. 7 to 9, the angle of the tube pin may not be adjusted, but it is directly pushed to the end and release the pushing action. The mounting of the fluorescent tube is achieved by the guiding of the guiding corner 115 at the bottom end of the mounting block 113, and the tube pins b smoothly slide into the two guiding slot 111. When the "Π"-shaped member 16 is pushed to the end by the tube pins b, the engaging teeth 132 of the engaging peg 13 is blocked by the teeth 122 at the circular edge on the axle 12, and rotated along the top edge of the protruded edge c such that the compressed spring 15 is released.

Thus, when the fluorescent tube is released, the engaging peg 13 which compresses the "Π"-shaped member 16 and the conducting copper plates 17 are lowered altogether. Before the tube pins b are lowered to the engaging slot 114, the bottom end edge of the two conducting copper plate 17 protrude out earlier along the curved surface 103 and engage with the engaging slot 114 so as to cut off the forward movement of the fluorescent tube. The tube pins b located at the conducting copper plates 17 are appropriately pressed by the member 16 to ensure that the tube pins b are in contact with the conducting copper plates 17. To disengage the fluorescent tube, the fluorescent tube is pushed upward to the end. In this operation, the "Π"-shaped member 16 is pushed to the top together with the conducting copper plates 17, the axle 12, and the engaging peg 13. The teeth 132 is rotated and is located at the top edge of the protruded rib c as a result of the teeth 122 at the circular edge of the axle 12, and urged against the top edge of the protruded rib. At the same time, the spring 15 is restored to its original shape and thus, the "Π"-shaped member 16 can maintain at the top position as a result of the arch-shaped corner at the bottom end of the copper plates 17 and the curved surface 103 which provides sufficient force to support the member 16. Thus, when the fluorescent tube is pushed to the top end, it can be dismantled therefrom.

In accordance with the preferred embodiment, the connection of the power source wire of the two conducting copper plates 17 is achieved by allowing the wire to pass into the through hole 141 of the hole cover and then connected at the engaging peg 13, or, the base seat 10 is provided with a through hole for the connection of power source wire.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A fluorescent light-tube seat structure having a seat body comprising;

a base seat having a front end being provided with a "Π"-shaped recess, and the bottom end of the lateral wall of the recess being a curved surface, and the center area of the top end of the seat body being a cylindrical slot in communication with the "Π"-shaped recess, the bottom end of the cylindrical slot being provided with a protruded edge, and the walls of the cylindrical slot being provided with two kinds of ribs of different height and thickness such that a lower protruded fib is located between two higher ribs, forming three ribs which are spaced apart;

a panel having two parallel straight guiding slots separated with a distance being equal to the distance of the tube pins, and a contacting end provided to the panel being provided with a plurality of insertion pegs and a mounting block being provided in between two guiding slots, the lateral sides of the mounting block being provided with an engaging slot and the bottom edge thereof being tilted toward the interior thereof;

an axle pivotally mounted at the hollow tube body of the cylindrical slot, having the top end formed into 6 wave-like elements and the external of the edge surface of the tube being formed into a plurality of corresponding teeth structures having a rail thereon;

an engaging peg being a hollow peg body mounted onto the top end of the axle, and the top end of the peg being a cap edge having a diameter smaller than that of the cylindrical slot, and the circumferential edge of the cap edge being formed into three engaging teeth structures;

a hole cover having a surface provided with a through hole for wires, and being used to seal the hole on the cylindrical slot;

a spring being urged between the top end of the engaging peg and the hole cover;

a "Π"-shaped member mounted at the bottom end of the axle and located in between the mounting block and the "Π"-shaped recess;

two conducting copper plates having a section at the bottom end thereof formed into an arch-shaped structure, and respectively mounted at the sides of the "Π"-shaped member.

2. A light tube seat structure as set forth in claim 1, wherein a power source wire is passed through a through hole located at the hole cover and via the engaging pegs and pivotally mounted with the two conducting copper plates.

* * * * *